US006446289B1

(12) United States Patent
Su et al.

(10) Patent No.: US 6,446,289 B1
(45) Date of Patent: Sep. 10, 2002

(54) INFLATTABLE MATTRESS

(76) Inventors: David P. Su, #1 Sunnyfield Dr., Rolling Hills Estates, CA (US) 90274; Monica Su, #1 Sunnyfield Dr., Rolling Hills Estates, CA (US) 90274

( * ) Notice: Subject to any disclaimer, the term of this patent is extended or adjusted under 35 U.S.C. 154(b) by 0 days.

(21) Appl. No.: 09/128,890

(22) Filed: Aug. 4, 1998

(51) Int. Cl.[7] ..... A47C 29/00

(52) U.S. Cl. ..... 5/709; 5/420; 5/706; 5/654; 5/655.3; 5/731

(58) Field of Search ..... 5/644, 413, 417, 5/682, 706, 654, 655.3, 731, 736, 932, 420; 441/126, 127, 129; 297/281.6, 452.41, DIG. 3

(56) References Cited

U.S. PATENT DOCUMENTS

| | | | | | |
|---|---|---|---|---|---|
| 24,618 | A | * | 3/1859 | Rosenberg et al. | 441/127 |
| 2,620,493 | A | * | 12/1952 | Brelsford | 5/413 |
| 2,834,970 | A | * | 5/1958 | Nappe | 5/655.3 X |
| 3,017,642 | A | * | 1/1962 | Rosenberg et al. | 5/655.3 |
| 3,553,748 | A | * | 1/1971 | Ross | 441/127 X |

* cited by examiner

*Primary Examiner*—Lynne H. Browne
*Assistant Examiner*—Fredrick Conley
(74) *Attorney, Agent, or Firm*—Robert J. Schaap

(57) ABSTRACT

An inflatable mattress capable of being folded or rolled into a small compact unit and unfolded or unrolled to a relatively flat or partially contoured body supporting condition. The mattress is comprised of an inner foam core of the type capable of being rolled or folded. An outer flexible and foldable fabric cover surrounds the foam core. Moreover, air spaces are formed in the foam core to allow a self-inflating when a valve on the mattress is opened. The mattress is air impervious and will remain inflated when the valve is closed. This construction also allows a deflating when the mattress is compressed and the valve is again opened. The mattress is characterized in that the major part of the upper surface area is provided with a plurality of closely spaced apart recesses formed in both the cover and the foam core and thereby define corresponding raised portions or projections between each of the recesses. The projections are relatively closely spaced apart from one another and thereby form a linear upper body supporting surface. In a more preferred embodiment, the raised portions are formed of a polygonal shape, such as a hexagonal shape. The foam core and the outer fabric cover are bonded together even in the region of this upper body supporting surface configuration thereby forming an effective integral unit of the foam core and cover when bonded together in this surface configuration. A method of making the mattress is also disclosed.

5 Claims, 8 Drawing Sheets

INFLATTABLE MATTRESS

BACKGROUND OF THE INVENTION

1. Field of the Invention

This invention relates in general to certain new and useful improvements in inflatable and deflatable mattresses and, more particularly, to inflatable and deflatable mattresses which have a cratered or non-level upper surface configuration on the upper or body supporting surface which thereby lends to improved body supporting comfort.

2. Brief Description of the Related Art

Inflatable mattresses of the type involved in the present invention are sometimes referred to as "camping mattresses" or "self-inflating" mattresses. The mattresses are sometimes referred to as "pads".

Generally, these mattress include an inner foam core in an outer fabric which may be disposed around or otherwise bonded to the inner foam core. Moreover, mattresses of this type are constructed with voids on the interior so as to allow an introduction of air when a valve on the mattress is opened. They also provide for a deflating by compressing the mattress, such as by rolling the mattress, to force the air out through the valve.

Mattresses of the aforesaid type are often referred to as self-inflating mattresses, as aforesaid, inasmuch as air will rush into the interior of the mattress if the valve is opened and the latter is unrolled. If the valve is then closed, the air remains in the mattress and the mattress is inflated. In like manner, upon compressing the mattress and opening the valve again, the air escapes and the mattress can be rolled or folded.

The initial self-inflating air mattress was disclosed in the Lea, et al Pat. No. 4,025,974, which had an inner foam core and an outer fabric cover surrounding that foam core. The mattress was effective, although it did not provide for a pillow construction in the mattress and, moreover, it contained a relatively flat upper body supporting surface.

The concept of shaping foam with a polygonal pattern, such as a hexagonal pattern, has also been taught in U.S. Pat. No. 5,688,538 to Barr, et al, and U.S. Pat. No. 5,534,208 to Barr, et al. Nevertheless, and heretofore, there has not been any body supporting mattress of the type in which the outer fabric cover is fully integrally bonded to the foam core and the foam core and fabric cover together form an upper surface shape having a non-level cratered surface configuration, that is, one with a raised portions and grooves therebetween.

It has been found in connection with the present invention that self-inflating mattresses of the aforesaid type often times can be relatively uncomfortable if they are not disposed on a perfectly flat surface. However, in camping conditions and the like, the surface upon which the mattress is disposed is rarely flat. As a result, any rocks, branches or the like which may be disposed beneath the bottom surface of and bearing against the bottom surface of the mattress will be felt by the user laying on the mattress. In addition, these mattresses only have an average depth or thickness of approximately a few inches when inflated. Thus, if the user should lie on this mattress in a position in which a portion of the body, such as an elbow, knee or the like, compresses the foam, the user will feel the hard surface of the ground which, again, may present an uncomfortable feeling.

There have been attempts in the past to provide an inflatable mattress having a dimpled upper surface, that is, an upper surface having an egg-crate type construction. This mattress construction relied primarily upon a foam core having this dimpled construction with a fabric cover disposed over the entire foam core. However, there was no attempt to seal the fabric cover to the foam core inasmuch there was no effective sealing means to obtain an integral bond throughout the entire dimpled surface area.

Efforts have been made to provide somewhat of an even body distribution on the surface of the mattress. However, it has been found that in most prior art devices, the foam will shift relative to the outer cover somewhat distorting the configuration of the mattress. In addition, it has also been found that a party attempting to recline on the mattress is not necessarily held in a fixed position on that mattress, since any turning movement of the party reclining on the mattress will tend to cause a shifting of the fabric with respect to the foam core. Not only is this uncomfortable, but it precludes a fixed retention of the reclining individual on the mattress.

There have been attempts in the past to use a partial bonding of a fabric cover to a foam core. These attempts also relied upon the so-called "spot bonding" and which was often referred to as "diamond bonding". In effect, the fabric was bonded to the foam core in selected areas. However, this construction proved to shorten the overall longevity of the mattress inasmuch as a body reclining on the mattress might tend to cause the fabric to shift with respect to the foam core in the event of movement of the reclining individual and this, in turn, caused the fabric to literally pull away from the foam core. In many cases, the fabric would actually tear thereby destroying the air impervious structure of the mattress.

It would be desirable to provide a self-inflating mattress of this type which had a non-level surface pattern and in which the foam core and the outer fabric cover also presented the same non-level surface pattern without any shifting movement therebetween.

In addition, there have been self-inflating mattresses of the aforesaid type which also have a pillow portion constructed into the mattress. One such mattress is more fully illustrated and described in U.S. Pat. No. 5,117,517, dated Jun. 2, 1992, to Ping-Hung Su, one of the applicants herein. It would also be desirable to provide a mattress of the aforesaid type having a non-level body supporting surface construction and also with a pillow constructed therein.

OBJECTS OF THE INVENTION

It is, therefore, one of the primary objects of the present invention to provide a self-inflating mattress which has a non-level upper surface construction and which is relatively comfortable to a user when the mattress is disposed on a ground surface.

It is another object of the present invention to provide a self-inflating mattress of the type stated which can be constructed with a polygonal surface pattern of grooves and raised portions on an upper surface thereof.

It is a further object of the present invention to provide a self-inflating mattress of the type stated which can be constructed with or without a pillow therein.

It is an additional object of the present invention to provide a self-inflating mattress of the type stated in which an outer fabric cover is disposed around a foam core and in which the cover is bonded to the foam core, such that the non-level upper surface pattern is integral throughout the entire mattress.

It is another salient object of the present invention to provide a self-inflating mattress of the type stated which can be constructed at a relatively low cost and which is highly efficient in use and operation.

It is yet an additional object of the present invention to provide a method of making a self-inflating mattress of the type stated having an inner core and an outer fabric and bonding the fabric to the core and simultaneously forming a non-level upper body supporting surface pattern thereon.

With the above and other objects in view, our invention resides in the novel features of form, construction, arrangement and combination of parts presently described and pointed out in the claims.

BRIEF SUMMARY OF THE INVENTION

The present invention relates in general terms to an inflatable mattress and, preferably, a self-inflating mattress capable of being folded or rolled into a small compact unit and unfolded or unrolled to a relatively flat body supporting condition. In this case, the body supporting condition could be a relatively flat condition so that the mattress serves as a sleeping mattress capable of being disposed on a ground surface. Otherwise, the mattress may be in the form of a pad capable of being disposed upon chairs or the like and to fit to the contour of the chair or other item. Nevertheless, the mattress of the invention is referred to as a mattress, since it will in that sense become a body supporting member.

The mattress of the present invention comprises an inner foam core of the type which is capable of being rolled or folded. An outer flexible and foldable fabric cover surrounds and encloses the inner foam core. Moreover, air spaces exist in the foam core so that the mattress can be expanded when a valve on the mattress is opened and deflated when the mattress is compressed and the valve is opened.

The inner foam core is intimately bonded to the inner surface of the outer fabric cover and is thoroughly bonded to all portions of the recesses or grooves and raised portions during the bonding process, as hereinafter described. When the fabric cover is bonded to the foam core, they effectively become an integral or a single unit.

In a preferred embodiment of the invention, the outer fabric cover is bonded to the foam core usually through a thermoplastic layer. Thus, when the thermoplastic layer is melted during the bonding operation, it will cause an integral bond between the outer fabric cover and the foam core, and even in the region of the grooves and raised portions. It is recognized that when the fabric cover becomes bonded to the foam core, that bond effectively creates an integral construction in which the fabric permanently becomes bonded to the core. This is particularly true because of the fact that the thermoplastic resin literally creates an integral-type bond which is not readily broken.

In the present invention, the outer cover may be made of a suitable plastic as, for example, one of more forms of vinyl plastic. The foam core may also be formed of a plastic material, such as a urethane material. In addition, the foam core is preferably of an open cell construction which will allow the foam to receive air and to permit the escape of air.

At least one surface of the mattress, such as the upper surface, or at least a major portion of the surface area of the upper surface, is provided with a cratered body supporting surface pattern. In this case, the surface pattern comprises a plurality of spaced apart grooves formed in the cover and in the foam core and thereby defined raised portions or projections. In effect, and in a generic sense, the surface therefore becomes somewhat of a "dimpled" surface as, for example, with a so-called egg crate type surface pattern.

Thus, in the present invention, the term "cratered" merely implies that there are projections and grooves in a major portion of the upper body supporting surface of the mattress. In effect, the upper surface is frequently referred to as a "cratered" surface inasmuch as there are a series of regular depressions formed in a substantial portion of the upper body supporting surface of the mattress. These depressions exist in regular and pre-determined patterns and thereby form raised portions or projections having the same pre-determined pattern as, for example, a polygonal pattern. Thus, the term "cratered" would also incorporate a so-called "dimpled" upper surface, that is, one with the so-called "egg-crate shaped construction. In a macro-sense, the upper surface is linear in most of the embodiments in view of the fact that the upper surfaces of each of the projections are flat. Moreover, the upper surfaces of each of these projections lie in the same horizontal plane when the mattress is disposed in a horizontal position. Thus, and in the macro-sense, one laying on the mattress or otherwise being supported by the mattress would generally feel a flat or level upper surface, although because of the grooves and projections, the upper surface is actually not a flat or non-level upper surface.

In a preferred embodiment, the raised portions are formed by polygons and, thus, the grooves themselves form polygonal shapes. Thus, the surface pattern could be in the form of a hexagonal shape, an octagonal shape, or the like. However, it is also possible to use other surface patterns as, for example, a surface pattern formed by circles, squares or the like.

It is preferable, in accordance with the present invention, to provide a surface pattern in which the recesses or grooves are continuous in that they are connected to one another and extend ultimately to the edges of the mattress or at least the edges of the cratered body supporting surface configuration.

The mattress could have a relatively flat top surface, except for the dimpled surface construction thereon. In other words, no pillow is formed therein, and one portion of the mattress would not lie out of a plane of another major portion of the mattress. However, it is also possible to construct the mattress with an integral pillow. In this case, the non-level body supporting surface pattern construction would not necessarily extend to the pillow section, since the latter should have a relatively smooth surface to function as a pillow.

The walls of the raised portions in the mattress can be vertically arranged when the mattress is disposed on a horizontal surface. Otherwise, the walls may be at an incline, such that the upper surface of a pattern, such as a polygonal pattern, has a smaller size than the base of the raised sections or projections in that pattern. In this sense, the side walls of the raised portions incline inwardly and upwardly. Nevertheless, the upper surfaces of each of these raised such portions are flat and all of the upper surfaces lie generally in the same horizontal plane.

In an even more preferred embodiment of the invention, it is preferable to have the recesses at a depth of between about one-sixteenth of an inch to about one-half of an inch. In a more preferred embodiment, the depth will range from about one-eighth inch to about one-fourth inch.

The present invention fulfills the above and other objects and advantages in the provision of a mattress which has a non-level surface and in which the mattress effectively becomes a single unitary construction. The present invention also fulfills the above and other objects in the provision of a method which achieves this mattress construction. This mattress and the method are further exemplified by the following detailed description and the accompanying drawings. However, it is to be understood that this following detailed description and the accompanying drawings are only set forth for purposes of illustrating the general principles of the invention. Therefore, this following detailed description and accompanying drawings are not to be taken in a limiting sense.

BRIEF DESCRIPTION OF THE DRAWINGS

Figure 1:
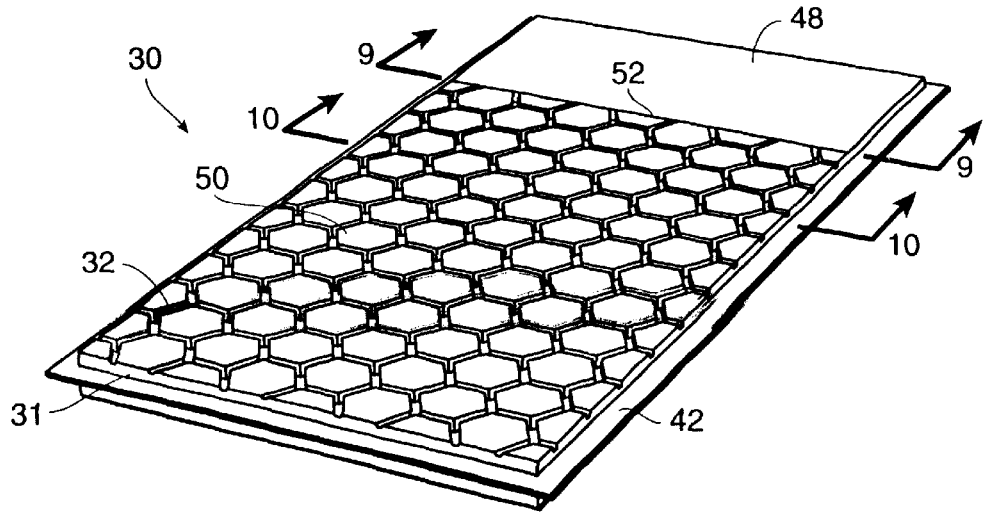
Figure 2:
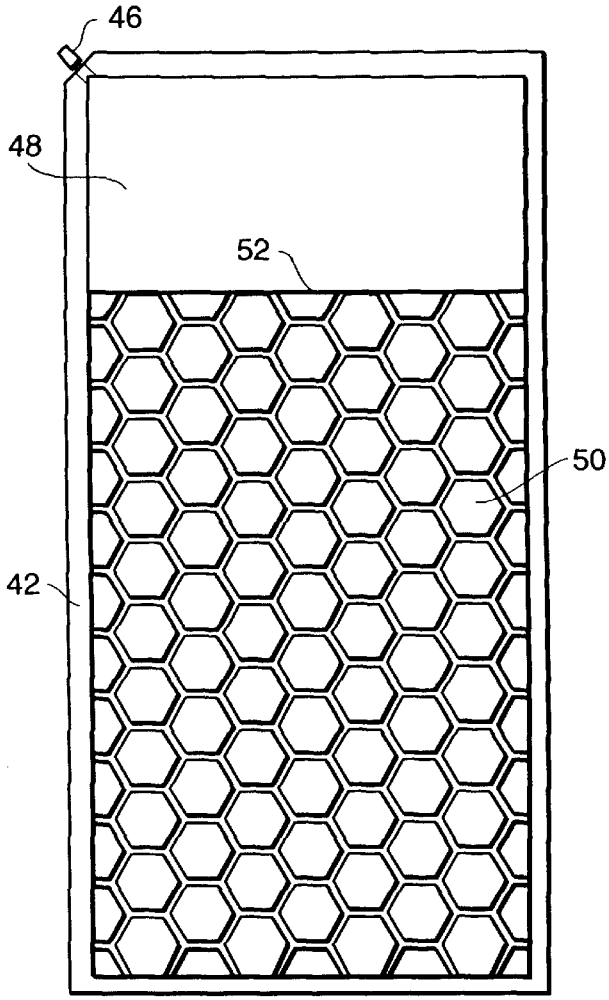
Figure 6:
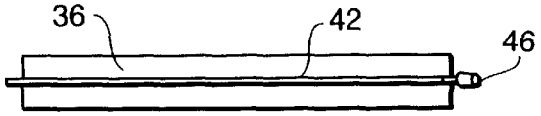
Figure 4:
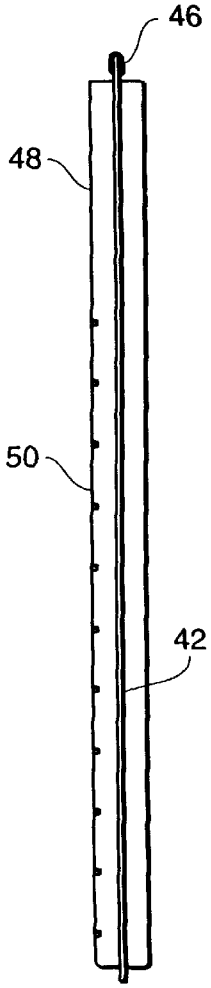
Figure 3:
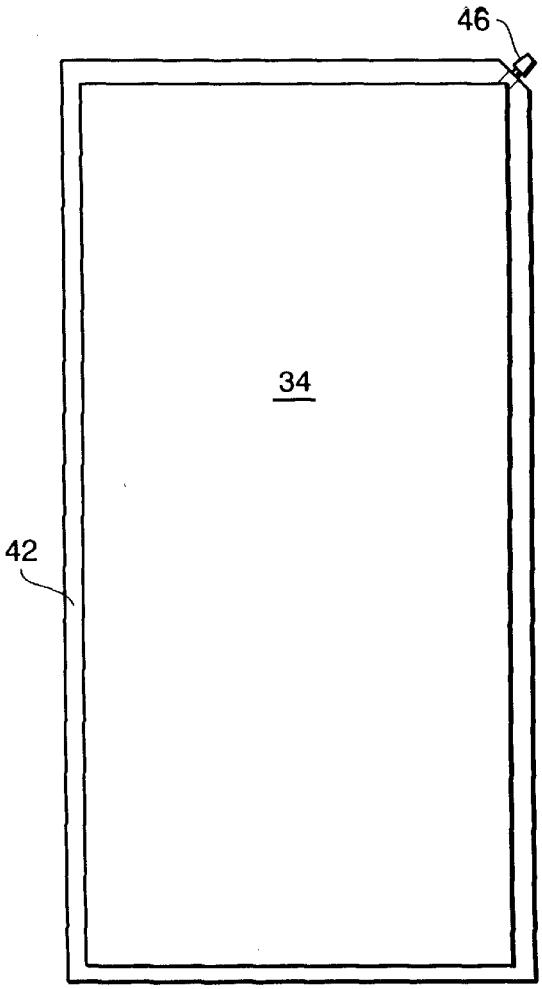
Figure 5:
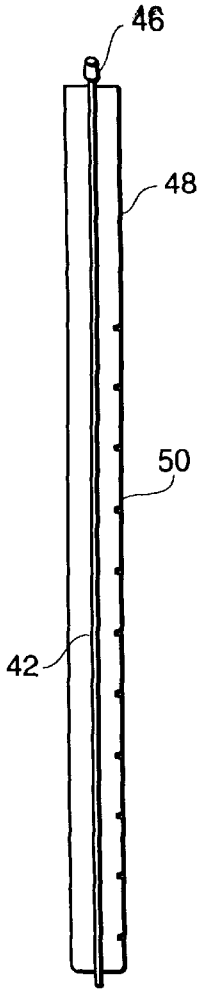
Figure 7:
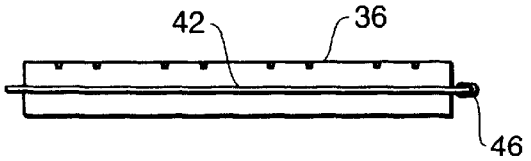
Figure 8:
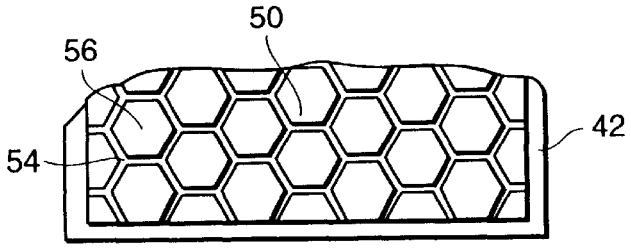
Figure 9:
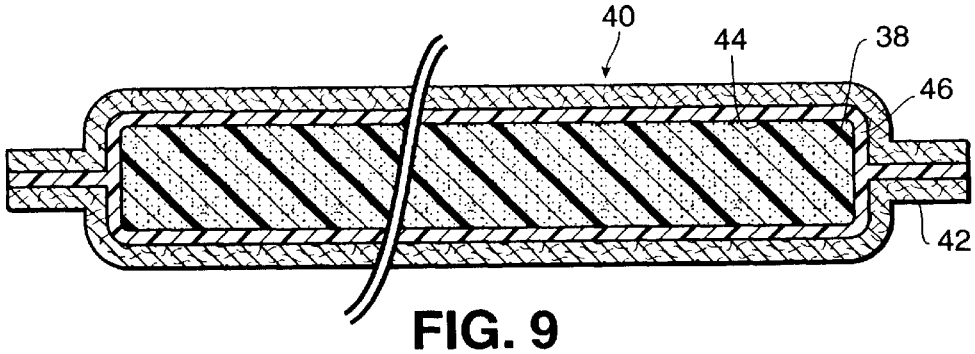
Figure 10:
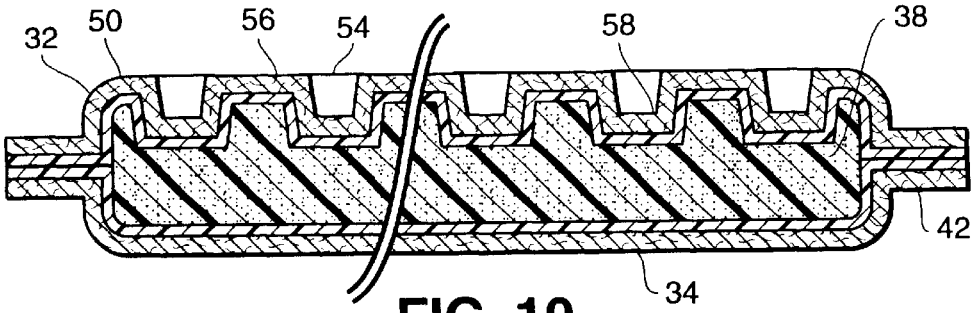
Figure 11:
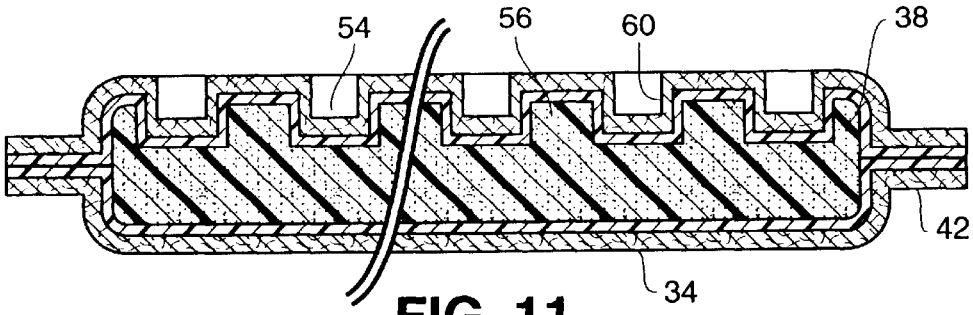
Figure 12:
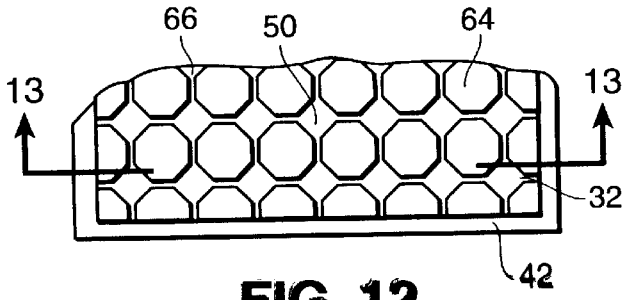
Figure 13:
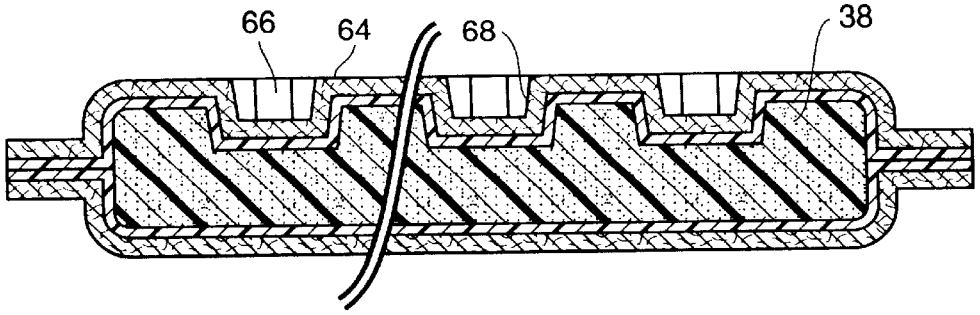
Figure 14:
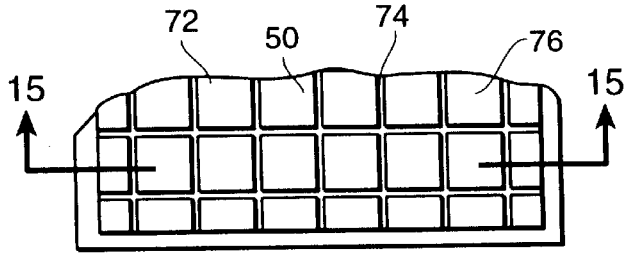
Figure 15:
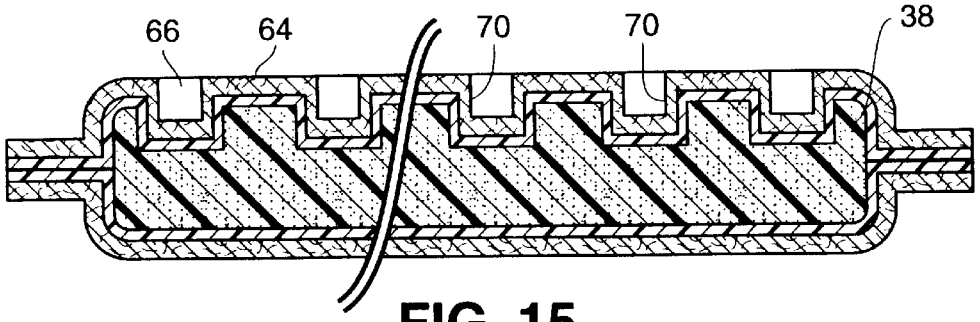
Figure 16:
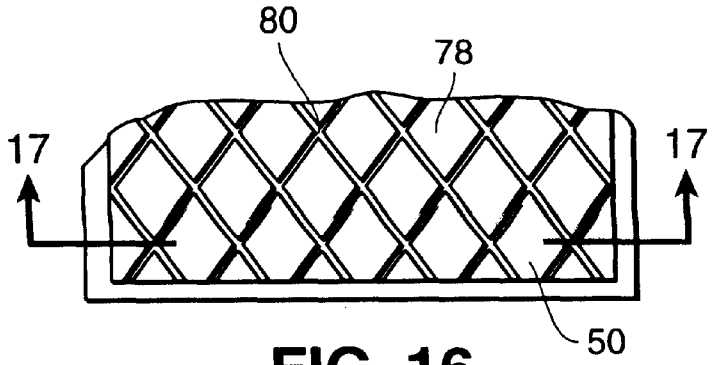
Figure 17:
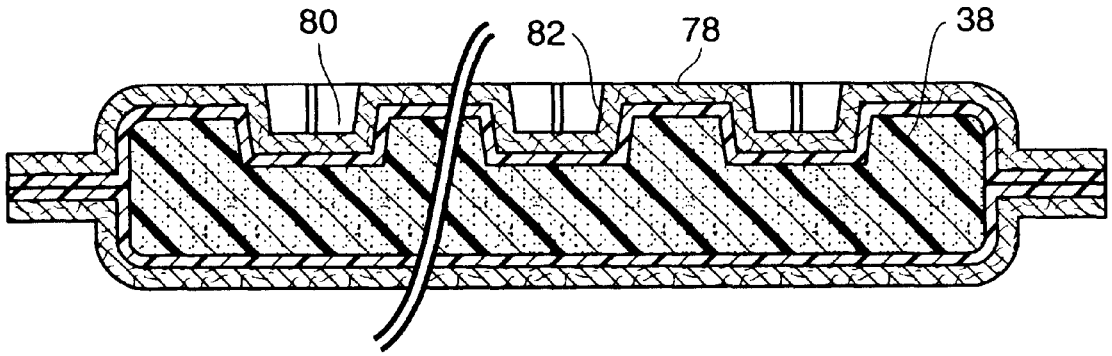
Figure 18:
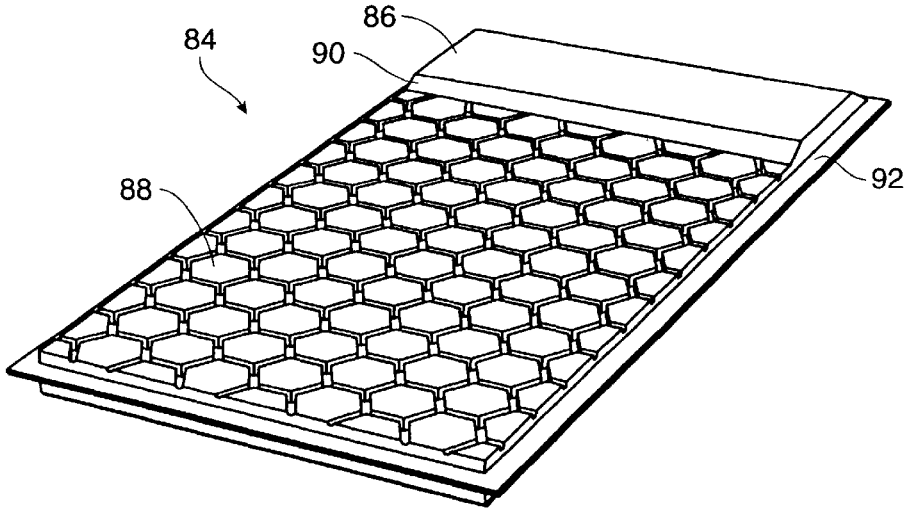
Figure 19:
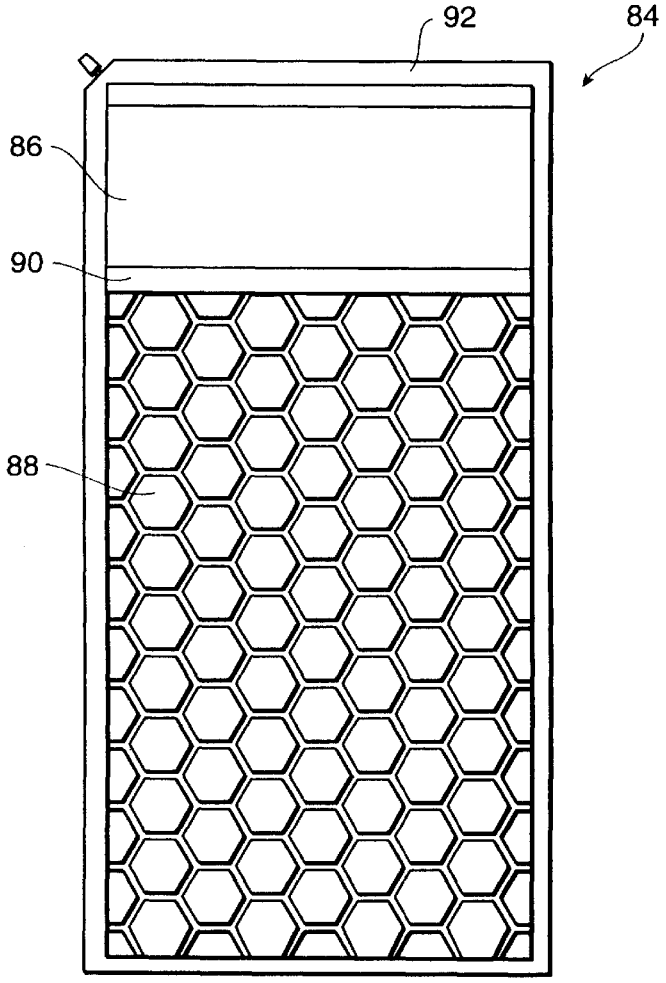
Figure 23:
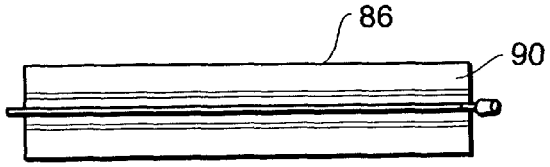
Figure 21:
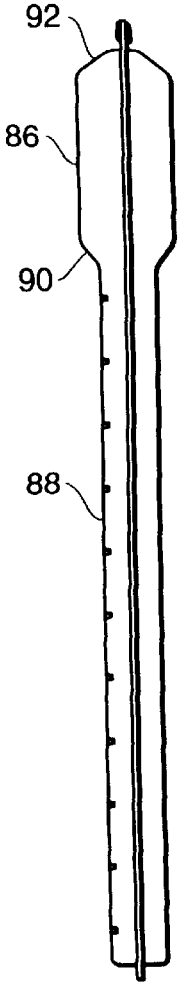
Figure 20:
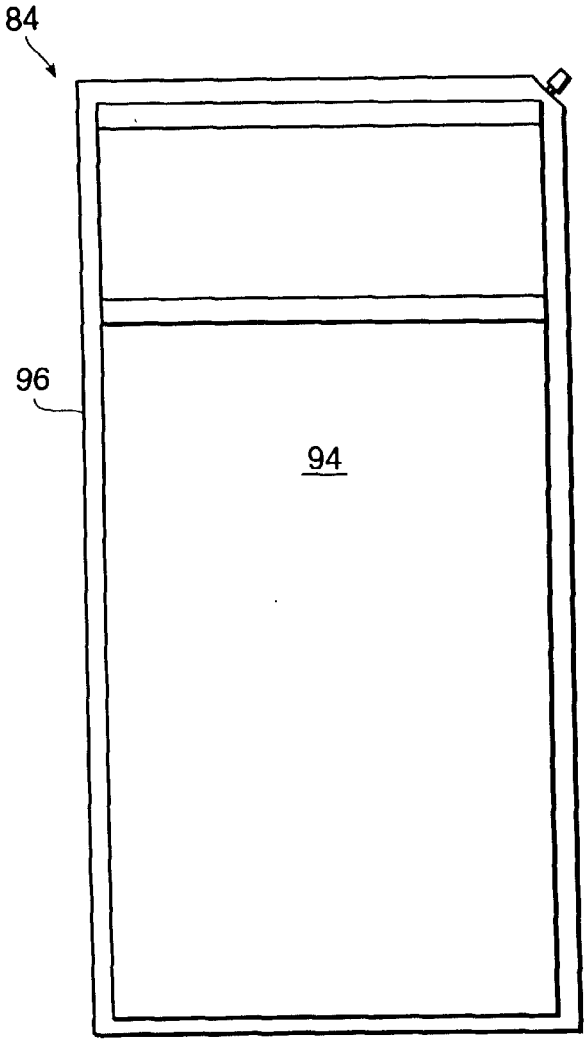
Figure 22:
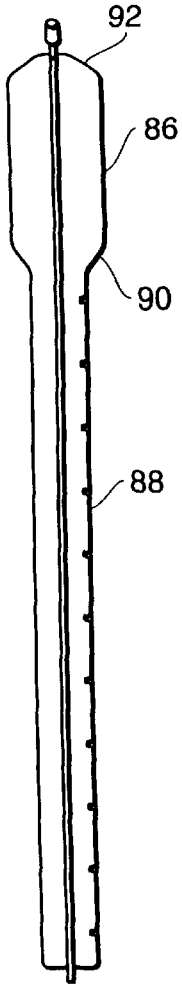
Figure 24:
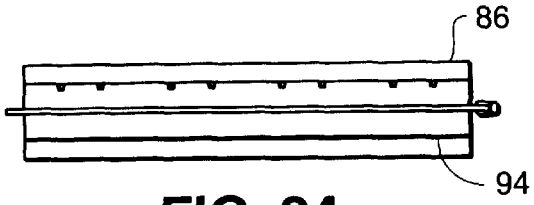
Figure 25A:
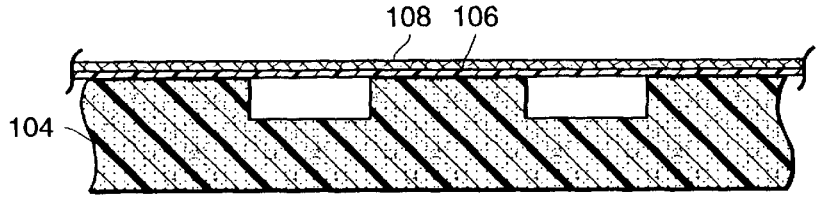
Figure 25B:
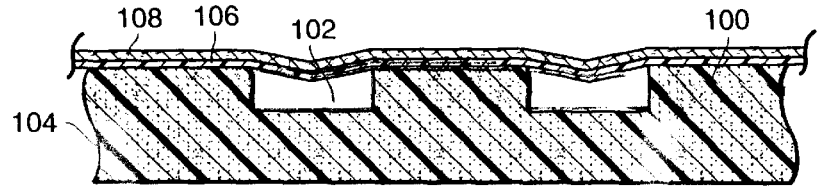
Figure 25C:
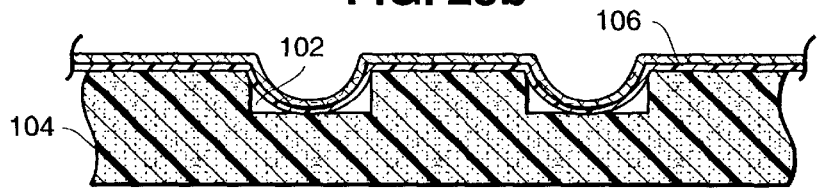
Figure 25D:
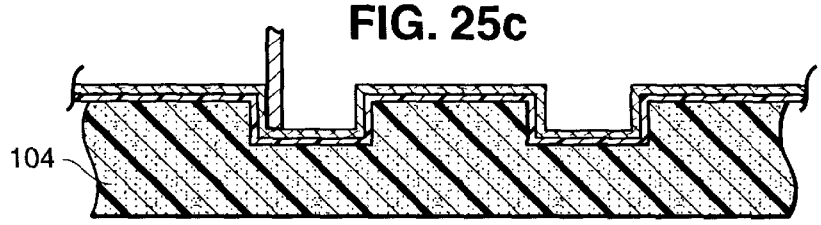
Figure 26A:
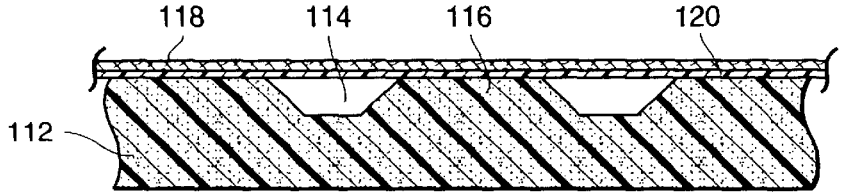
Figure 26B:
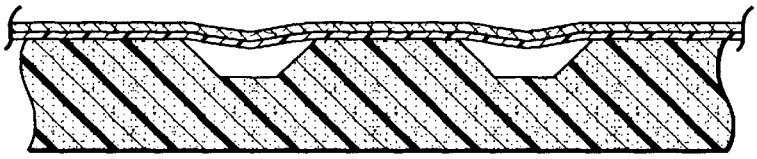
Figure 26C:
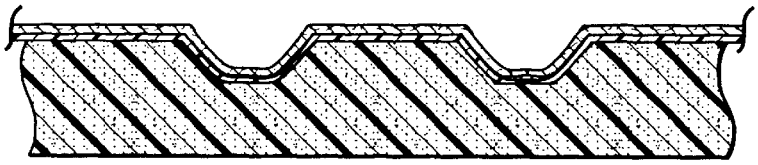

Having thus described the invention in general terms, reference will now be made to the accompanying drawings in which:

FIG. 1 is a perspective view of a self-inflating mattress constructed in accordance with and embodying the present invention;

FIG. 2 is a top plan view of the mattress of FIG. 1;

FIG. 3 is a rear plan view of the mattress of the present invention;

FIG. 4 is a side elevational view of the mattress of the present invention;

FIG. 5 is an opposite side elevational view of the mattress of the present invention;

FIG. 6 is a top plan view of the mattress of the present invention;

FIG. 7 is a bottom plan view of the mattress of the present invention;

FIG. 8 is a fragmentary enlarged plan view of a portion of the corner of the top surface of the mattress of the present invention;

FIG. 9 is a fragmentary vertical sectional view taken along line 9—9 of FIG. 1;

FIG. 10 is a fragmentary vertical sectional view taken along line 10—10 of FIG. 1;

FIG. 11 is a fragmentary sectional view, somewhat similar to FIG. 10, and showing a modified form of cratered upper body supporting surface pattern for the mattress in accordance with the present invention;

FIG. 12 is an enlarged fragmentary plan view of a portion of a corner of a mattress in accordance with the present invention showing an octagonal surface pattern construction;

FIG. 13 is an enlarged vertical fragmentary sectional view taken along line 13—13 of FIG. 12;

FIG. 14 is an enlarged fragmentary plan view of a corner of the mattress in accordance with the present invention and showing a rectangular surface pattern configuration;

FIG. 15 is a vertical sectional view taken substantially along line 15—15 of FIG. 14;

FIG. 16 is an enlarged fragmentary top plan view of a portion of a mattress construction in accordance with the present invention and showing a rhombic surface pattern configuration;

FIG. 17 is a vertical sectional view taken along line 17—17 of FIG. 16;

FIG. 18 is a perspective view of another modified form of mattress constructed in accordance with and embodying the present invention and using a pillow construction therein;

FIG. 19 is a top plan view of the mattress of FIG. 18;

FIG. 20 is a rear elevational view of the mattress of FIG. 18;

FIG. 21 is a side elevational view of the mattress of FIG. 18;

FIG. 22 is an opposite side elevational view of the mattress of FIG. 18;

FIG. 23 is a top plan view of the mattress of FIG. 19;

FIG. 24 is a bottom plan view of the mattress of FIG. 19;

FIG. 25 is a composite of four views, comprised of FIGS. 25*a*, 25*b*, 25*c* and 25*d*, showing a portion of the method of making a mattress of the present invention and the formation of grooves and raised portions with vertical side walls therein; and FIG. 26 is a composite of three views, comprised of FIGS. 26*a*, 26*b* and 26*c*, showing a modified form of method in accordance with the present invention and showing the formation of grooves and raised sections with inclined side walls thereof.

DETAILED DESCRIPTION OF PREFERRED EMBODIMENTS

Referring now in more detail and by reference characters to the drawings, which illustrate several practical embodiments of the present invention, 30 designates one embodiment of a mattress in accordance with the present invention and which has a relatively linear overall top surface configuration.

The mattress 30 is constructed with a top surface 32 and a bottom surface 34, along with a side wall 36 extending therearound. Referring momentarily to FIGS. 9 and 10, it can be observed that the mattress is formed of an inner foam core 38 and an outer fabric cover 40 which extends fully therearound and encloses the inner foam core 38. The outer fabric cover 40, in the embodiment as shown, may be upper and lower sheets which are seamed along one side and integral on other sides or otherwise may be a pair of separate sheets and seamed together along a continuous side wall seam 42.

In the embodiment as shown in FIG. 9, a thermoplastic layer 44 is located on the inner surface of the fabric cover or on the exterior surface of the foam and when heated, causes a bonding of the fabric to the foam, in a manner to be hereinafter described in more detail. However, it should be understood in connection with this invention that the thermoplastic bonding layer 44 is only one form of bonding layer which can be used and is the most preferred bonding layer. However, other bonding materials could also be used for this purpose.

The thermoplastic bonding material preferably exists in the form of a relatively thin layer and is preferably applied to the interior surface of the outer fabric cover. The thermoplastic bonding layer may be applied by spraying or other conventional techniques. Some of the thermoplastic materials which may be used in the present invention include, for example, polyethylene, polypropylene, and many polycarbonates.

It is also possible to use thermosetting resins, such as the polyesters, including styrene based polyesters. Some of the thermosetting resins would include epoxies and other phenolics and vinyl esters.

The foam core which is employed is preferably a urethane foam core. However, any foam material which is relative non-stretchable but which is nevertheless compressible and flexible and foldable can be used. The foam core should preferably also be formed of a low density open cell foam material. The density of the foam core should be in the range of about 0.5 to about 3.5 pounds per cubic foot. Higher density foam patterns could also be employed, if necessary, although the recommended densities described herein are preferred.

Various polyurethane foam materials are effective for use as the foam core. Moreover, the foam core should be of an open-celled construction. In this way, air can be entrapped in the cells when the foam core is allowed to expand to its normal size and the air can be expelled from these cells by compressing the core. In this way, when the valve on the mattress is opened, the foam core will expand to its normal size, as shown in FIGS. 1 and 2, and air will enter into the cells. Conversely, when the cells are compressed, the air is pushed outwardly therefrom and out of the valve of the mattress. For this purpose, the mattress is provided with a valve 46.

The valve 46 which is employed is of a generally conventional construction. However, it is a manually operable valve and one that is either opened or closed by manual manipulation, such as by turning the valve to open in one direction and turning in the opposite direction to close the valve. Thus, when the valve 46 is opened, if the foam core is initially rolled or compressed and allowed to unroll or expand, air will automatically enter into the mattress. When the valve is closed, air will remain in the mattress even when an individual reclines on the mattress. Thus, the mattress has an air-impervious construction. Opening of the valve and compression of the mattress, such as by rolling of the mattress, will force the air from the intersticies of the foam core outwardly and the air will exit through the open valve. When the valve is closed while the mattress is compressed or rolled, the mattress will generally retain that fixed, compressed or rolled state.

The upper surface of the mattress is subdivided into a head section 48 and a body section 50. In this embodiment of the invention, and although the body section 50 has a non-level surface configuration and surface appearance, as hereinafter described, the head section 48 is relatively flat on its upper surface. In other words, the head section 48, although relatively flat, lies generally in the same plane as the body section 50 when the mattress is horizontally disposed. The head section could be separated from the body section, if desired, by a line of demarcation or such as a groove 52, if desired.

Substantially the entire surface area of the body section 50 is provided with recesses or grooves 54 and forming projections 56 surrounded by the grooves 54. In the embodiment of the invention as illustrated, this surface configuration of grooves and recesses is preferably formed with polygonal grooves and projections, although other types of grooves and recesses could be employed. In the preferred embodiment, as shown in FIGS. 10–12, the polygonal grooves are preferably hexagonally shaped recesses in horizontal cross-section and, hence, the raised sections are hexagonally shaped in horizontal cross-section.

In the preferred embodiment of the invention, each of the grooves are essentially continuous in that they will extend to the edge of the mattress. Thus, all of the grooves are interconnected and the pattern of the hexagonally shaped projections or raised portions is also regular and continuous through the surface area of the body section. By reference to FIGS. 10 and 12, it can be seen that the top surfaces of each of the projections or raised portions 56 are relatively flat. Thus, the top surfaces have an appearance as shown in FIG. 8. If a horizontal sectional view were taken through the projections at the base, they would also have an appearance as shown in FIG. 8, except of slightly larger size, for reasons as hereinafter described in more detail.

Referring to FIG. 11, it can be seen that projections 56 are formed by inclined walls 58 which extend into and define the sides of the grooves 52. It is for this reason that the base of each projection would have a size slightly larger than the top surface if a horizontal section were cut through the projection at the base.

The formation of the projections 56 with inclined walls 58 has been found to be quite advantageous in that it enables the fabric to be readily fully bonded to the foam core on its entire surface area. As indicated previously, it is quite important in connection with the present invention to insure that there is a full integral bonding of the entire surface area of the foam core with the interior surface of the fabric cover wherever the fabric cover is in contact with the foam core. This bonding provides the high degree and comfort and longevity enabled by the mattress of the present invention.

Although it is possible to use vertical walls connecting the projections to the grooves, as hereinafter described, it is for this reason that the inclined walls are preferred. Thus, when examining FIG. 10, it can be seen that the fabric is fully bonded to the core along the entire surface area where the core is in contact with or disposed in juxtaposed relationship to the interior surface of the fabric cover.

As indicated above, it is also possible to use vertically arranged walls or straight walls 60 connecting the projections to the recess or grooves 54 and defining the grooves, as best shown in FIG. 11 of the drawings. This construction also provides an effective mattress in accordance with the invention, although the inclined walls 58 are preferred, as indicated above, primarily due to the fact that the fabric immediately bonds to the surface of the core in the entire area where there is a juxtaposed positioning of the two components.

In the embodiment of FIG. 11, however, it may be necessary to use some hand formation, immediately after or during the heating to achieve a complete bonding, that is, by running a hot bar through the various grooves. This will insure that the fabric is effectively tucked to the core at the very base thereof so that there is an entire bonding throughout the fabric and the core. However, and although the construction of FIG. 11 is encompassed by the present invention, that construction shown in FIGS. 9 and 10 is preferred.

FIG. 12 illustrates an embodiment of the invention in which the surface configuration is formed of octagonally shaped projections 64 defined by octagonally shaped recesses or grooves 66. In this case, the top surfaces of the octagonal projections 64 are relatively flat, much in the same manner as with the hexagonal pattern, and the bases of the octagonal projections 64 would have corresponding shape, but of a slightly larger size at the base portion thereof. The side walls 68 of these octagonal projections 64 are also inclined in the preferred embodiment, as shown in FIG. 13. In this way, there is a complete assurance that all portions of the surface area of the fabric cover are bonded to the inner foam core.

It is also possible to use vertical walls 70 connecting the projections 64 to the grooves 66 and which also define the grooves 66, as best shown in FIG. 15 of the drawings. Again, and although the surface configuration can be formed with projections having vertical walls merging into the grooves 66, the inclined walls 68 are preferred for the same reasons previously advanced. Again, when using the vertical wall 70 in the formation of the mattress, some hand operation in the process may typically be required, and even then sealing is not as effective as with the inclined side walls.

FIG. 14 illustrates an embodiment of a mattress in which there are a plurality of projections 72 connected by and defined by recesses or grooves 74. In this case, the projections 72 are all rectangularly shaped. Moreover, the grooves are effectively straight linear rows of grooves. Although this arrangement is effective in the present invention, it is preferred to use polygonal shaped projections and, hence, polygonal shaped grooves. Moreover, the projections 72 are connected to the groves 74 by generally vertically arranged walls 76. It should be recognized, however, that the walls 76 in this case could be and are preferably inclined walls of the type shown in FIG. 13.

FIGS. 16 and 17 illustrate a mattress with a surface configuration having rhombic or so-called "diamond-shaped" projections 78 formed by grooves 80. Again, the upper surface of each of these projections 82 is flat and are connected to the base of the grooves 80 by means of inclined walls 76, as best shown in FIG. 17 of the drawings. However, it should also be understood that vertically arranged walls could be used much in the same manner as shown in connection with the other embodiments of the invention.

It should be recognized that the various surface patterns, as shown in FIGS. 8–17, are only exemplary of numerous surface pattern configurations which could be employed. Thus, circular projections could be used, if desired. The present also contemplates the use of the so-called "dimpled" surface configuration, that is, a surface configuration with the egg-crate shaped construction. However, and as stated above, the polygonal shaped projections are preferred. Nevertheless, pentagonally shaped projections, etc. could also be used in one preferred embodiment. However, in all embodiments of the invention, it is necessary to insure a complete and full bonding of the outer fabric cover to the foam core for the entire surface area in which the two are disposed in juxtaposed relationship to one another. Thus, the entire surface of the projections and, for that matter, the surfaces of the grooves in the foam core are integrally bonded to the outer cover.

FIGS. 18–24 illustrate another embodiment 84 constructed in accordance with and embodying the present invention. This mattress 84 comprises a pillow section 86 and a body supporting section 88. In this case, the body section 88 has an upper surface configuration similar to the body supporting configuration of any of those mattresses previously described. Thus, for example, the body supporting section could have a hexagonally shaped surface pattern configuration, an octagonally shaped surface pattern or the like. The difference between the mattress 84 and the mattress 30 is that this mattress 84 includes an integrally formed pillow 86 and which is internally constructed as an integral part of the foam core and the outer fabric cover. Moreover, and in the preferred embodiment, the pillow section 86 is connected to the body supporting section through a tapered wall 90. In addition, the outer edge of the pillow section 86 is also connected to the remainder of the mattress by an inclined wall 92, all as best shown in FIGS. 18 and 22 of the drawings. The mattress 84 is also provided with a bottom wall 94 connected by a side wall 96. In some embodiments, the pillow section 86 may also protrude beyond the surface of the rear wall, as also shown in FIGS. 21 and 22 of the drawings.

The construction with the pillow in FIGS. 19–24 also utilizes a complete adherence of the outer cover to the foam core and even in the pillow section as well as the body supporting section. Moreover, the surface pattern configuration in the body supporting section would also adopt any of those configurations as previously described.

FIGS. 25*a*–25*c* illustrate an embodiment of the invention in which projections 100 are formed by corresponding recesses 102. In this case, the fabric cover 106 with a bonding layer 108 is applied over the outer flat surface of the foam core 104. In the next stage of the method of the invention, a platen having a flat lower surface (not shown) is pressed against the upper surface of the three layers. When the platen is heated, the thermoplastic layer 108 will melt causing an integral bonding of the outer cover 106 to the foam core 104. Moreover, the platen compresses the form core causing the cover 106 to move into the recesses 102 and, hence, over the sides of the projections 100. In accordance with FIG. 25*b*, it can be seen that the cover 106 is being moved over the projections and into the recesses. In accordance with FIG. 25*c*, is can be seen that by use of a platen alone, the outer fabric cover 106 is not fully bonded to the foam core 104, at least in corner portions of the recess 102. Thus, and after this, a hand operation is required in the step of FIGS. 25*d* to insure a complete bonding. In this case, a heated metal bar 110 is used to force the cover 106 and bonding layer 108 to be pushed into the corners of the grooves 102. In many cases, even the bonding is not fully satisfactory, although it is possible to use a mattress of this type in accordance with the present invention.

In the embodiment as shown in FIGS. 25*a*–25*c*, it is also possible to use a foam core, as well as a platen, with pre-formed grooves 102 and projections 100 formed therein. In this way, the platen which is used will only be required to force the outer fabric cover 106 and the bonding layer 108 carried thereby into the corresponding recesses.

FIGS. 26*a*–26*c* also show an embodiment of the invention in which there is a foam core 112 having recesses 114 with corresponding projections 116 formed therebetween. Moreover, an outer fabric cover 118 having a bonding layer 120 on the under surface thereof is disposed over the upper surface of the core 112. In this way, a platen (not shown) can be used to force the outer fabric cover 120 into the corresponding recesses 114. The fabric cover is initially forced into the recess 114, as shown in FIG. 26*b* and fully pushed into the groove 114, as shown in FIG. 26*c*. Moreover, by reference to FIG. 26*c*, it can be seen that the fabric is fully fitted into the groove 114 while the foam is compressed and while in the groove, the fabric is intimately bonded to the core. Moreover, this process also places the fabric under tension, which is desirable in accordance with the present invention.

The self-inflating mattress of the present invention provides numerous advantages over the prior art mattress constructions. The modified surface containing the projections and grooves has planer areas which help to localize pressure points and relieves any pressured imposed by relatively sharp objects on a ground surface. This, in effect, promotes better sleeping comfort.

The grooves formed in the mattress also provide for good ventilation in order to dissipate excess humidity and any heat generated during warm external environment conditions. In addition, the surface pattern of projections and grooves also provides an additional gripping force which prevents a user of the mattress from slipping off of the mattress. In this respect, and due to the fact that the outer fabric cover is tightly secured to the foam core, there is no slipping of the fabric on the foam core. Moreover, the grooves and projections preclude any slipping of the individual from the mattress.

It should also be understood in connection with the present invention that the pillow in those embodiments of the mattress which utilize a pillow could be formed of a separate foam piece. This foam piece could be formed of a softer foam construction then that used with the body portion of the mattress and, thus, provide additional head resting support.

Thus, there has been illustrated and described a unique and novel self-inflatable mattress and a method of making the same and which fulfills all of the objects and advantages which have been sought therefor. It should be understood that many changes, modifications, variations and other uses and applications which will become apparent to those skilled in the art after considering the specification and the accompanying drawings. Therefore, any and all such changes, modifications, variations and other uses and applications which do not depart from the spirit and scope of the invention are deemed to be covered by the invention.

Having thus described the invention, what we desire to claim and secure by letters patent is:

1. A method of making an inflatable mattress of the type having an inner foam core and an outer fabric cover surrounding and enclosing the inner foam core forming an interior and with air spaces in the interior to allow inflating and deflating of the mattress, said method comprising:

a) providing an inner foam core having closely spaced apart recesses and projections formed on a portion of an upper surface thereof;

b) providing a bonding material surrounding said inner foam core of the type which will melt and enable a bonding of the foam core to an outer fabric material upon application of heat;

c) surrounding the foam core and bonding material in an outer fabric material to provide a fully enclosed interior to the mattress with air spaces to allow inflating and deflating of the mattress through a valve structure;

d) heating said bonding material and fabric material and to enable a bonding of the outer fabric material to the foam core; and e) simultaneously with the heating of the bonding material and fabric material causing a platen to press into an upper surface of said outer fabric material and simultaneously force the fabric into the plurality of closely spaced apart recesses causing a complete integral bonding of the fabric material to the foam core on the entire upper exterior surface having the recesses and projections, thereby defining an integral construction across a major portion of the upper exterior surface of said mattress with the recesses and the projections constituting the upper reclining surface so that air may flow between the mattress and a person reclining thereon to permit dissipation of body heat.

2. The method of making an inflatable mattress of claim 1 further characterized in that said inner foam core is formed of an open celled construction and which is somewhat compressible upon application of a force to a surface thereof.

3. The method of making an inflatable mattress of claim 1 further characterized in that said method comprises providing a thermoplastic bonding layer between said outer fabric and inner foam core.

4. The method of making an inflatable mattress of claim 1 further characterized in that said method comprises forming said raised sections with inclined side walls.

5. The method of making an inflatable mattress of claim 1 further characterized in that said method comprises forming said raised sections with flat vertical walls when an upper surface of the mattress is horizontally disposed.

* * * * *